United States Patent [19]

Cunningham et al.

[11] Patent Number: 4,836,870

[45] Date of Patent: Jun. 6, 1989

[54] EMULSION-TYPE EXPLOSIVE COMPOSITIONS

[75] Inventors: Glenn R. Cunningham, Upper St. Clair; Alex Senules, Pittsburgh, both of Pa.

[73] Assignee: Mitchell Chemical Co., Upper St. Clair, Pa.

[21] Appl. No.: 103,511

[22] Filed: Oct. 1, 1987

[51] Int. Cl.[4] ..... C06G 45/00

[52] U.S. Cl. ..... 149/2; 149/46; 149/61; 149/109.6; 149/110

[58] Field of Search ..... 149/2, 46, 61, 109.6, 149/110

[56] References Cited

U.S. PATENT DOCUMENTS 4,357,184 11/1982 Binet et al. ..... 149/2
4,555,278 11/1985 Cescon et al. ..... 149/2
4,619,721 10/1986 Cescon et al. ..... 149/2
4,676,849 6/1987 Curtin et al. ..... 149/2
4,714,503 12/1987 Cescon et al. ..... 149/2
4,737,207 4/1988 Ehrn//ström et al. ..... 149/2

*Primary Examiner*—Stephen J. Lechert, Jr.
*Attorney, Agent, or Firm*—Webb, Burden, Ziesenheim & Webb

[57] ABSTRACT

A method for the pre-emulsification of fuel oil or other carbonaceous compound and water in the presence of one or more emulsifying compositions or emulsifier constituents, prior to the addition to and emulsification of an aqueous solution of the ammonium nitrate or other oxidizer salt. In contrast to compositions prepared by emulsifying all constituents simultaneously, the pre-emulsion of the fuel oil and water with fatty acid and salts and/or amines consistently enables preparation of emulsion-type explosive compositions having uniform, fine particle size. The emulsions thus produced detonate readily and are stable to cold (to −20° C.), to heat (to 90° C.) and to water (24 hour immersion).

9 Claims, No Drawings

EMULSION-TYPE EXPLOSIVE COMPOSITIONS

FIELD OF THE INVENTION

The invention relates to ammonium nitrate-containing emulsions, and other emulsion-type explosive compositions, useful in excavating operations such as are required in construction, mining and quarrying.

INTRODUCTION

The explosive compositions traditionally well known for their applications in mining and construction excavations, such as the nitroglycerin-based explosives including trinitrotoluene, have largely been replaced in the excavation industries by the emulsion-type explosive compositions. Because these compositions contain ammonium nitrate or other "oxidizer salts," they are less expensive by far than the TNT-type explosives. Ammonium nitrate-containing compositions, in particular, are commercially attractive to producers because the widely available "fertilizer grade" ammonium nitrate, commonly called prilled ammonium nitrate, is sufficiently pure for use.

As ammonium nitrate-containing explosives have developed, a number of compositions have become available, which compositions contain a wide variety of constituents and may be prepared by a number of different methods. The need for formulation of the ammonium nitrate arose because ammonium nitrate is itself insufficiently sensitive for satisfactory initiation or propagation of blasting. The additives to the composition are therefore added to sensitive initiation, enhance density, impart water resistance, promote stability and safety in handling, and generally to increase the commercial viability of the ammonium nitrate-containing product.

BACKGROUND OF THE INVENTION

A number of oxidizer salt-containing compositions, intended for use as blasting agents or explosives generally are known in the art. A number of patents which disclose representative ammonium nitrate-containing emulsions include U.S. Pat. No. 3,161,551, No. 3,447,978, No. 3,674,578, No. 3,715,247, No. 4,008,108, No. 4,104,092, No. 4,111,727, No. 4,218,272 and Canadian Pat. No. 804,541. Each of these patents discloses one or more variations on the general emulsion preparation of ammonium nitrate, water and a fuel oil, and these compositions are generally well known in the art.

A number of additional patents highlight the improved results which accompany the inclusion of a specific additive in the ammonium nitrate/water/oil emulsions discussed above. U.S. Pat. No. 4,110,134 to Wade includes waxes and closed cell void-containing material. U.S. Pat. No. 4,138,281 incorporates microbubbles in the ammonium nitrate-containing emulsion; Canadian Pat. No. 862,669 discloses the incorporation of hollow glass particles in the emulsified ammonium nitrate-containing compositions. U.S. Pat. No. 4,181,546 to Clay discloses the use of high shear to minimize emulsifier inclusion. Canadian Pat. No. 933,780 discloses a method for making blasting agents thixotropic. U.S. Pat. No. 4,149,917 to Wade discloses a water-in-oil explosive composition having no sensitizer other than occluded air. U.S. Pat. No. 3,765,964 to Wade discloses the use of strontium ion as a detonation catalyst. U.S. Pat. No. 3,770,522 discloses the use of a stearate salt emulsifier such as sodium stearate. U.S. Pat. No. 4,149,916 to Wade identifies inorganic perchlorate as an advantageous co-constituent with ammonium nitrate. U.S. Pat. No. 4,216,040 to Sudweeks et al. discloses the use of emulsifiers having unsaturated hydrocarbon chains therein, such as fatty acid amine or ammonium salts. U.S. Pat. No. 4,357,184 to Binet et al. discloses the use of an amphiphatic synthetic polymeric emulsifier. U.S. Pat. No. 4,404,050 to York et al. discloses the incorporation of unrefined or partly refined petroleum products, for example, slackwax, in emulsion explosives in addition to or in substitution for refined petroleum fuels. U.S. Pat. No. 4,420,349 to Bampfield discloses the use of a dimer acid glyceride emulsifier. U.S. Pat. No. 4,102,240 to Cook et al., entitled "Blasting Slurried Pump Truck," discloses a pump truck for handling aqueous slurry blasting agents which mixes and pumps the compositions into the on-site boreholes.

Three U.S. Patents disclose the use of various fatty acid salts as emulsifying agents in emulsion-type explosive compositions. These patents are U.S. Pat. No. 4,141,767 to Sudweeks et al., U.S. Pat. No. 4,287,010 to Owen, II, and U.S. Pat. No. 4,555,278 to Cescon et al. Sudweeks et al. disclose the use of a fatty acid amine or ammonium salt emulsifier having a chain length ranging from 14 to 22 carbon atoms. Owen, II discloses the in situ preparation of a fatty acid salt by the agitation of oil in the presence of a fatty acid and an ammonium or alkali metal hydroxide. Cescon et al. also disclose the in situ preparation of a fatty acid salt of an alkali metal, ammonium or alkylammonium compound. The fatty acid salt emulsifiers enhance uniformity and stability of the final emulsion and product.

Unfortunately, when ammonium nitrate and other oxidizer salts known in the art are emulsified with water, fuel oil, and emulsifier, emulsions generally tend to form with a wide distribution of particle sizes. These nonuniform emulsions demonstrate instability in that the ammonium nitrate or other oxidizer salt regularly appears as a solid precipitate out of the discontinuous phase, presumably as a direct or indirect result of the wide particle size distribution. The absence of uniform fine particles, moreover, thwarts optimum detonation. Lack of storage stability and optimal detonation capacity are, of course, serious commercial obstacles in the preparation and distribution of these explosives.

A need remains, therefore, for a method of producing an emulsion-type explosive composition, and for an emulsion-type explosive composition produced therewith, wherein the known and widely-used constituents of the emulsion-type explosive composition may be emulsified in such a way as to give uniform fine emulsions, improved storage stability, and maximized detonation capacity.

SUMMARY OF THE INVENTION

In order to meet this need, the present invention provides a method for the pre-emulsification of fuel oil or other carbonaceous compound and water in the presence of one or more emulsifying compositions or emulsifier constituents, prior to the addition to and emulsification of an aqueous solution of the ammonium nitrate or other oxidizer salt. In contrast to compositions prepared by emulsifying all constituents simultaneously, the pre-emulsion of the fuel oil and water with fatty acid and salts and/or amines consistently enables preparation of emulsion-type explosive compositions having uniform, fine particle size. The emulsions thus produced detonate readily and are stable to cold (to −20° C.), to heat (to 90° C.) and to water (24 hour immersion).

DETAILED DESCRIPTION OF THE INVENTION

In the context of the present process and product, the term "oxidizer salts" signifies a composition selected from the group consisting of ammonium nitrate, sodium nitrate, potassium nitrate, lithium nitrate, calcium nitrate, magnesium nitrate, barium nitrate, zinc nitrate, alkylamine nitrates including methylamine nitrate, ethylamine nitrate and propylamine nitrate, alkanolamine nitrates including ethanolamine nitrate, propanolamine nitrate, and isopropanolamine nitrate, sodium chlorate, potassium chlorate, calcium chlorate, lithium chlorate, ammonium perchlorate, sodium perchlorate, calcium perchlorate, potassium perchlorate, lithium perchlorate, magnesium perchlorate, barium perchlorate and zinc perchlorate. For the purpose of the present invention, however, the preferred oxidizer salt is ammonium nitrate, which need not be incorporated in pure form but may be used in the so-called fertilizer grade, usually "prilled" ammonium nitrate, which is inexpensive and widely available.

In the formulation of the oxidizer salt into a useful water-in-oil emulsion-type explosive, a pre-emulsion is prepared first, with subsequent addition of an aqueous solution of one of the oxidizer salts identified above. Pre-emulsions prepared according to the present method generally incorporate a fuel, an emulsifier, and water, which constituents are emulsified to form the pre-emulsion. The fuels, emulsifiers, and methods are described below.

The fuels suitable for incorporation into the pre-emulsion of the present invention are, generally speaking, known in the art. More particularly, however, the fuels are generally fuel oils such as hydrocarbon oils or other carbonaceous oils or fuels. In addition to the hydrocarbon fuels (C 32 1–10 or higher), other fuel oils or liquid fuels such as diesel fuel oil, benzene, toluene, xylene, alcohols, glycols and liquid carbohydrates or sugars may be used. The preferred fuel oils are the liquid paraffinic oils of relatively low viscosity, such as a No. 2 Diesel oil.

The fuel or fuel oil is emulsified with water by means of an emulsifier. Broad latitude in the selection of the emulsifier is permissible within the scope of the present method. Suitable emulsifiers include the alkali-, ammonium- or alkylammonium-hydroxides as well as fatty acid salts or oleates or amine derivatives such as dimethanolamine oleate, triethanolamine oleate, dimethylethanolamine oleate and the like. Lauryl amine acetate, or related amines of fatty materials such as tall oil, may be used, such as the tall oil amide of tetraethylene pentamide. Other emulsifiers known in the art are suitable for use in the present method and composition as they are suitable for use in the prior art oxidizer salt-containing emulsion-type explosive compositions.

Central to the present method is the pre-emulsification of the fuel or fuel oil with the water and emulsifier. The emulsifier composition may be synthesized in situ by the addition to the fuel or fuel oil and water of the reactive constituents of the emulsifier. (See the example, below.) Generally, the fuel or fuel oil, water and emulsifier (the term "emulsifier" includes emulsifiers per se or two or more reactive constituents of emulsifiers) are charged to appropriate emulsifying equipment, such as a Smith Homogenizer, in ratios known in the art. (As is well documented in the literature, the amount of fuel oil selected should be that which provides oxygen balance to the quantity of oxidizer salt present.) Emulsification should take place at "medium" speed, or at about 2,000–5,000 r.p.m.

The resultant preemulsion is an oil-in-water emulsion, is milky in appearance, and is generally characterized as a homogeneous fluid having a pH in excess of about 8.2, with a weight in pounds per gallon between 7.72–8.00 and a viscosity (at 70° F., 21.1°) of 20–24 Zahn 2 (approximately 50 centipoise). The particle size in dispersion is between 0.4–1.5 microns (average). The pre-emulsion may be stored indefinitely, prior to the preparation of the final emulsion-type explosive composition as described below.

In order to prepare the final emulsion-type explosive composition, oxidizer salt is charged to water, at about 190° F., to yield a hot aqueous solution of oxidizer salt containing approximately 83% oxidizer salt. The pre-emulsion and hot oxidizer salt solution are then co-emulsified, at a ratio of approximately 6:1 by volume, at high speed. For example, the co-emulsification of the pre-emulsion and the hot oxidizer salt solution may be carried out in the same Smith Homogenizer identified above, but at a high r.p.m. such as 6,000 r.p.m. A final emulsion results from this high-speed emulsification which is a "pumpable" water-in-oil emulsion in which the particle size of the discontinuous phase is between 0.6 and 1.0 microns.

Although the emulsion-type explosive composition prepared in accordance with the present method may be used alone, it may also be blended with other material such as ANFO (ammonium nitrate/fuel oil admixtures known in the art), microballoons such as the oxygen-free glass microspheres, metallic nitrates, perchlorates and other materials designed to impart specific properties such as bulk density, viscosity and sensitivity. These various minor modifications are well known to one skilled in the oxidizer salt-containing emulsion-type explosive arts.

The following example is illustrative of the present invention.

EXAMPLE

Three-hundred forty seven and four tenths parts by weight of fuel oil were admixed with 46.3 parts by weight oleic acid, 30.9 parts by weight dimethylethanolamine and 347.4 parts by weight water. The combined charge was agitated at medium speed in a Smith Homogenizer. During agitation the oleic acid and the dimethylethanolamine reacted in situ to yield a branched chain amine oleate having a carbon count of C=22. The relatively high carbon count was believed to impart particular stability to the pre-emulsion and also to the final emulsion as prepared below.

Eighty three parts by weight of prilled ammonium nitrate (fertilizer grade) was charged to a vessel with 17 parts by weight of water, and the combined ammonium nitrate and water was heated to 190° F. Upon the completion of heating, all the prilled ammonium nitrate had gone into aqueous solution (at a concentration of 83%). Six parts of the hot (190° F.) ammonium nitrate solution was combined with one part by volume of the pre-emulsion prepared above, and the constituents were co-emulsified in a Smith Homogenizer at 6,000 r.p.m. The final emulsion thus produced was a water-in-oil emulsion-type explosive composition of pumpable viscosity. The final emulsion demonstrated excellent detonation properties, and stability to cold (to −20° C.) to heat (to 90° C.) and to water (24 hour immersion). Within the parameters of these conditions, ammonium nitrate did not precipitate from the final emulsion composition, and the emulsion retained its pumpable viscosity.

Although the invention has been described with respect to particular constituents and specific methods above, the invention is only to be limited insofar as is set forth in the accompanying claims.

I claim:

1. A method for preparing an emulsion-type explosive composition containing an oxidizer salt, comprising:

(a) pre-emulsifying a composition consisting essentially of a fuel, an emulsifier and water; and (b) subsequently emulsifying the resultant pre-emulsion with an aqueous solution of an oxidizer salt.

2. The method according to claim 1 wherein step (a) further comprises the step of:

(a) pre-emulsifying a fuel, selected from the group consisting of carbonaceous oils, hydrocarbon oils, diesel fuel oil, benzene, toluene, xylene, alcohols, glycols, liquid carbohydrates, and liquid sugars, an emulsifier and water; and.

3. The method according to claim 1 wherein step (b) further comprises the step of:

(b) subsequently emulsifying the resultant pre-emulsion with an aqueous solution of an oxidizer salt selected from the group consisting of ammonium nitrate, sodium nitrate, potassium nitrate, lithium nitrate, calcium nitrate, magnesium nitrate, barium nitrate, zinc nitrate, alkylamine nitrates, alkanolamine nitrates, sodium chlorate, potassium chlorate, calcium chlorate, lithium chlorate, ammonium perchlorate, sodium perchlorate, calcium perchlorate, potassium perchlorate, lithium perchlorate, magnesium perchlorate, barium perchlorate and zinc perchlorate.

4. The method according to claim 1 wherein step (b) further comprises the step of:

(b) subsequently emulsifying the resultant pre-emulsion with an aqueous solution of ammonium nitrate.

5. The method according to claim 1 wherein step (a) further comprises the step of:

(a) pre-emulsifying a fuel and water with an emulsifier selected from the group consisting of alkali metal hydroxides, ammonium hydroxides, alkylammonium hydroxides, fatty acid salts, dimethylethanolamine oleate, dimethanolamine oleate, triethanolamine oleate, and lauryl amine acetate; and.

6. The method according to claim 1 wherein step (a) further comprises the step of:

(a) pre-emulsifying a fuel, oleic acid, dimethylethanolamine and water; and.

7. The method according to claim 1 wherein step (a) and (b) further comprise the steps of:

(a) pre-emulsifying equal parts by weight of a fuel oil and water with oleic acid and dimethylethanolamine; and (b) subsequently emulsifying the resultant pre-emulsion at 6,000 r.p.m. with six parts by volume of a hot aqueous solution of 83% ammonium nitrate for each one part by volume of pre-emulsion.

8. A water-in-oil emulsion prepared in accordance with claim 1 wherein said composition is a water-in-oil emulsion, further wherein the discontinuous aqueous phase of said emulsion further comprises particles having average diameters between about 0.6–1.0 microns.

9. A water-in-oil emulsion prepared in accordance with the method of claim 1 wherein said composition is characterized by stability to cold (to −20° C.), to heat (to 90° C.) and to water (24 hour immersion).

* * * * *